United States Patent [19]

Staheli

[11] Patent Number: 4,993,120

[45] Date of Patent: Feb. 19, 1991

[54] APPARATUS AND METHOD FOR PREVENTING PERMANENT IMPRESSIONS IN A FIBER WEB DELIVERED FROM A FEED CHUTE DURING A MACHINE STOPPAGE

[75] Inventor: Paul Staheli, Wilen b. Wil, Switzerland

[73] Assignee: Maschinenfabrik Rieter AG, Winterthur, Switzerland

[21] Appl. No.: 349,413

[22] Filed: May 8, 1989

[30] Foreign Application Priority Data

May 11, 1988 [CH] Switzerland ..... 01794/88

[51] Int. Cl.[5] ..... D01G 23/02

[52] U.S. Cl. ..... 19/105; 19/98; 19/0.2

[58] Field of Search ..... 19/54, 65, 81, 97.5, 19/105, 106, 145.5, 204, 0.2, 0.21, 0.23, 0.25

[56] References Cited

U.S. PATENT DOCUMENTS

| | | | |
|---|---|---|---|
| 159,923 | 2/1875 | Harwood | 19/105 X |
| 3,548,461 | 12/1970 | Reiterer | 19/97.5 X |
| 3,728,759 | 4/1973 | Hergeth | 19/105 |
| 4,154,485 | 5/1979 | Lytton | 19/105 X |
| 4,510,647 | 4/1985 | Keller et al. | 19/105 |
| 4,657,444 | 4/1987 | Pinto | 19/105 X |

FOREIGN PATENT DOCUMENTS

| | | |
|---|---|---|
| 0176668 | 9/1986 | European Pat. Off. . |
| 2004394 | 8/1971 | Fed. Rep. of Germany . |
| 1390285 | 1/1965 | France . |
| 0015222 | of 1893 | United Kingdom . |

*Primary Examiner*—Werner H. Schroeder
*Assistant Examiner*—Ismael Izaguirre
*Attorney, Agent, or Firm*—Burns, Doane, Swecker & Mathis

[57] ABSTRACT

A card feed is disclosed in which, in order to prevent machine stoppages from causing the formation of permanent impressions in a fiber web delivered from a feed chute, a displaceable delivery roller is movable on the occasion of a machine stoppage by means of a pressure-operated reciprocating actuator from an operative position, in which the fiber web is being compressed between a pair of delivery rollers, into another position in which the fiber web is no longer compressed to an extent such that a permanent impression would be produced in it during the period of machine stoppage.

19 Claims, 4 Drawing Sheets

1.2
2
3
4
5
65
66
71
62
60
70
19.1
63
64
71;70
32
14.1
28
61
18
16
11.1
15
59
1.1

APPARATUS AND METHOD FOR PREVENTING PERMANENT IMPRESSIONS IN A FIBER WEB DELIVERED FROM A FEED CHUTE DURING A MACHINE STOPPAGE

FIELD OF THE INVENTION

The invention relates to the delivery of a fiber web from a feed chute for supplying fibers to a fiber preparation machine such as a card. It is concerned particularly with methods and apparatus which will reduce the compression forces on the fiber web during intervals when the carding machine is stopped, so that an indentation or more highly compacted zone will not be formed in the portion of the web that is to be advanced into the carding machine upon the return of such machine to its operating condition.

BACKGROUND

It is known for cards and cleaning machines to be supplied by means of pneumatic conveying lines with fiber flocks which are separated from the conveying air by a separator and supplied to a feed chute which is usually positioned below the separator.

A chute of this kind has been described, for example, in an article entitled "Die Neue Kardenspeisung Aerofeed-U", published in the February 1986 issue of the journal "mittex". The article discloses that the pneumatically supplied flocks are conveyed by means of a separating head into a feed chute in which the flocks are separated from the air conveying them.

The flocks are delivered from the chute by means of feed rollers and supplied by way of an opening cylinder to a second stock chute lower down, from which they are delivered by means of a pair of non-displaceable delivery rollers and, through the agency of one of the two such rollers and of another displaceable pressing roller, are conveyed further, for example, to a guide plate of a card.

The pressing roller is either weight-biased or spring-biased so that resulting pressure consolidates or compresses the web at a predetermined pressure.

A disadvantage can arise in connection with the use of such arrangements. When the card is stopped and delivery of the feed web ceases for a time, even though temporarily, a compressed zone is produced in the web because of the pressing between the pressing roller and the delivery roller. This zone does not return to its original shape after regular machine operations are resumed. That is, a web zone that has been compressed for a time between stationary rollers will not spring back to anything like the same extent as a web which has been fed continuously through such a compression zone. The web could be said to "breathe" much less in a zone compressed for a time between stationary feed means than in the rest of the web which has been compressed at the same pressure but while being conveyed continuously.

Such indentations or more highly compacted zones in the fiber web being supplied to the carding instrumentalities have been found to be sources of irregularities in slivers produced by the card. Such irregularities are undesirable, particularly in systems which include automatic control systems intended to make possible the production of uniform slivers.

OBJECTS AND SUMMARY OF THE INVENTION

It is an object of the invention to obviate disadvantages of the type noted above.

A more particular object of the invention is to provide a method and apparatus which will serve to relieve the compression action exerted on a fiber web in the supply path to a fiber preparation machine during times when the web is not being advanced, so as to avoid the later presentation to the fiber preparation machine of a fiber web in which some zones are compacted to a greater extent than others.

A further object is to improve the uniformity of the output of a card by methods and apparatus for avoiding the introduction, during periods of card stoppage, of irregularities in the fiber web being supplied to a card.

In accordance with the invention, the supply system for a fiber preparation machine includes means which exert a compression force on a moving fiber web being fed to the machine during normal operations but such means is so controlled that the compression force is relieved when the machine is stopped. In one embodiment, for example, the web normally is pressed between two rollers but, when the advance of the web into the fiber preparation machine is stopped, one of the rollers is moved away from the other roller to free the web from the pressing action. Then, upon the resumption of web feeding, the roller which had been moved away is returned to its active position to again exert compression forces on the web as it moves along the supply path.

The invention is particularly advantageous when applied in connection with the supply of cotton fibers to a card. Cotton fiber flocks from a feed chute are formed into a web whose crosssectional density may be sensed and measured on its way to the nip between the feed roller and the feed plate at the card. Through use of the present invention, undesired displacements and deflections in the inner structure of portions of the web of the occasions of machine stoppages are avoided.

BRIEF DESCRIPTION OF THE DRAWINGS

These and other objects, features and advantages of the invention may be more fully understood from consideration of the descriptions made hereinafter with reference to the drawings, in which.

DETAILED DESCRIPTION OF PREFERRED EMBODIMENTS

Figures 1, 2:
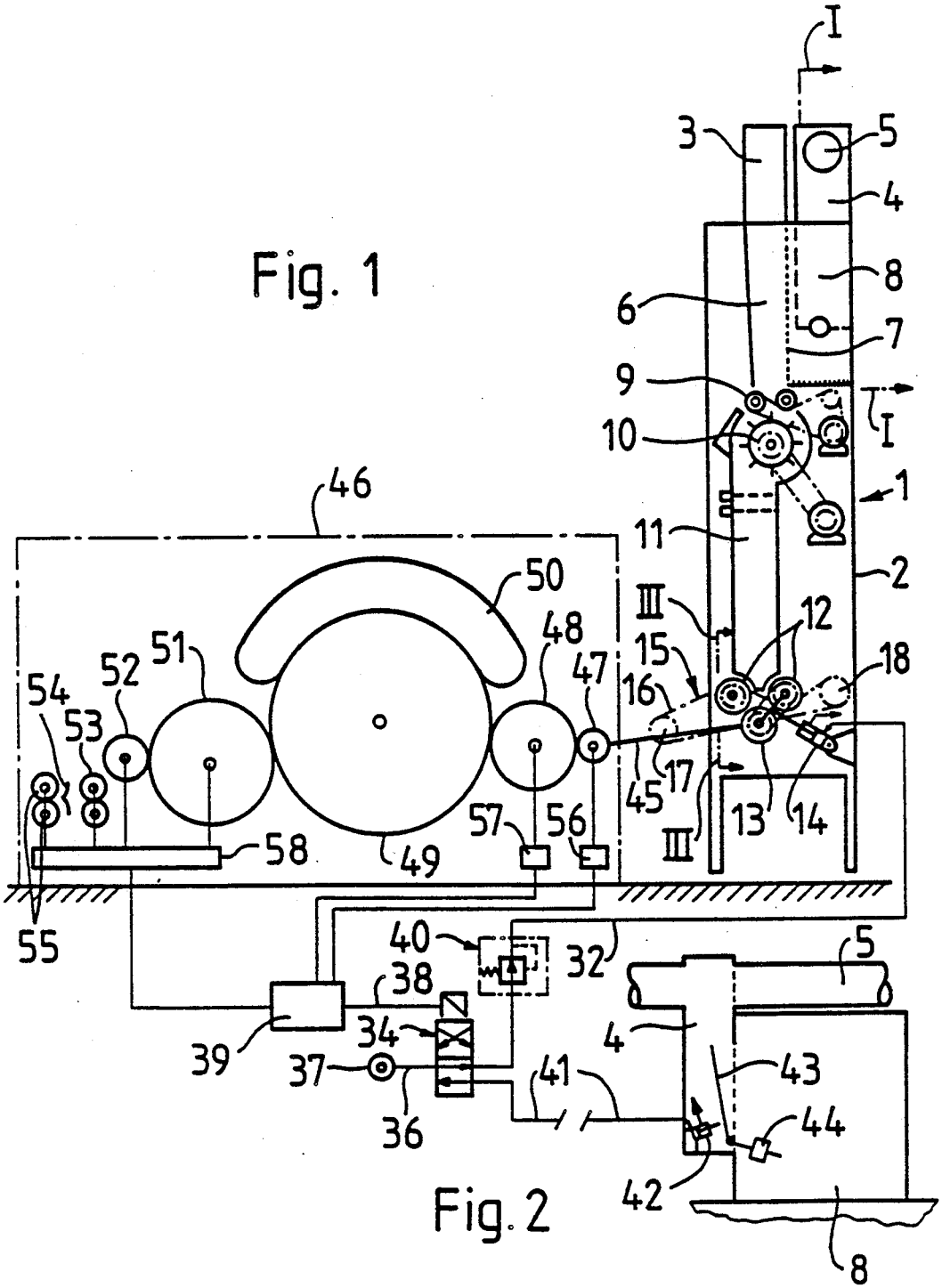
FIG. 1 is a view in semi-diagrammatic form through a feed chute according to the invention, the chute being followed by a card.
FIG. 2 shows a detail of the chute of FIG. 1 on the line I—I thereof.

Referring initially to FIG. 1, fiber flocks enter the system at the upper right of this view. A separating head 3 and an exhaust air casing 4 are connected to a casing 2 of a feed chute 1. Casing 4 is connected to an exhaust air pipe 5.

An air separation chute 6 extends downwardly (looking at FIG. 1) in casing 2. It is disposed below the head 3, as considered in the direction of movement of the fiber flocks, and is bounded by a perforate plate 7.

The chute 6 receives a mixture of flocks and air which is conveyed by way of the head 3 into the chute 6. The flocks remain therein while the air passes through the plate 7 into an exhaust chamber 8 and therefrom by way of the casing 4 into the exhaust pipe 5.

The chute 6 then comprises feed rollers 9 and an opening cylinder 10 which respectively deliver the flocks in the chute 6 and open the flocks further and deliver them to a stock chute 11.

Disposed at the bottom end of the chute 11 as shown in FIG. 1 (i.e., at the exit of the chute 11 as considered in the direction of flock flow) are two non-displaceable delivery rollers 12 which are adapted to deliver the flocks from the chute 11 and which are rotatable around their axes of rotation. The rollers 12 are driven by a drive 15 indicated in chain-dotted lines. This drive comprises a chain 16, a driving wheel 17 and an idler gear 18. The chain extends around sprockets 19 (FIG. 5) on the respective delivery roller shafts in such a way that the delivery rollers rotate in opposite directions.

Another roller 13 also is provided. It is displaceable. To drive this displaceable delivery roller 13, sprockets are disposed one at each end of the shafts of the delivery rollers 12 and 13; the sprockets being interconnected by a chain 20 so that the torque transmitted by the sprocket 19 to the corresponding non-displaceable roller 12 can be transmitted by the chain 20 to the displaceable roller 13. Both shafts of the non-displaceable rollers 12 have a sprocket 19.

Also, each of the non-displaceable delivery rollers 12 is non-displaceably mounted by means of a pivot bearing 21 and 22 in the casing 2 while the displaceable roller 13 has its shaft mounted at both ends in pivoted links 23 and 24 (only the link 24 being visible in FIG. 4) which are pivotally received by the shaft of the roller 12 on the right as viewed in FIG. 1. The latter shaft is designated by the reference character 25.

The links 23 and 24 are rigidly interconnected by way of a stirrup 26 pivotally connected by way of a pivot 27 to a pressure-operated reciprocating actuator or cylinder 14. This is pivotally connected by way of a pivot 29 to a bracket 30 rigidly secured to the casing 2 (see FIG. 4).

The non-displaceable rollers 12 are separated from one another by a fixed gap or spacing A but the operative gap or spacing B between the displaceable roller 13 and the non-displaceable roller 12 opposite the same usually corresponds to the gap arising due to compression of the fiber web by the force produced by the actuator 14. The gap B is, as a rule, not fixed but corresponds to the thickness of the fiber web passing between the rollers.

The displaceable roller 13 is pivotable away from the opposed roller 12, in the direction indicated by an arrow W, into a normal or inoperative position until the gap B corresponds substantially to the gap A.

The actuator 14 is a single-acting pressing cylinder having a spring (not shown) for the inwards movement of plunger 31. The actuator 14 is pressurized by means of a pressure line 32 and, for the outwards movement, air is vented in the direction indicated by an arrow 33.

As can be gathered from FIG. 1, the line 32 is connected to an electrically controlled single-acting 4-way 2-position diverter or valve 34.

The diverter 34 is pneumatically connected by way of a line 36 to a compressed air supply 37 and electrically connected by way of a line 38 to a control 39.

A pressure-reducing valve 40 can be provided in the line 32 to control the pressure for the actuator 14. In the absence of any such valve the pressure in either the line 36 or supply 37 must be controlled; alternatively, the actuator 14 is selected in accordance with a given air pressure and a required force.

Figure 3:
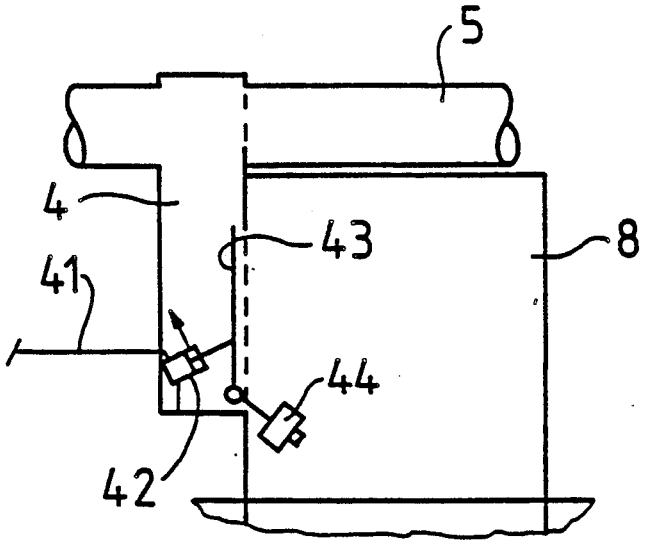
FIG. 3 shows a detail of FIG. 2 but with a further detail thereof in a different operative position.

As can also be gathered from FIG. 1, another pressure line 41 extends to a single-acting actuator 42, the same being effective, in the absence of conveyance of flocks into the chute 6, to close an air control flap 43 closing the plate 7. The actuator 42 is not connected to the flap 43 since the same must be able to pivot in a predetermined zone for its operation. To this end, the flap 43 is connected to a balance weight 44. The function of the flap 43 has been described in the journal article previously mentioned and will therefore not be referred to further. FIG. 3 shows the flap 43 in the closed state and in engagement with the plunger rod of the actuator 42.

As can also be gathered from FIG. 1, the feed chute 1 communicates by way of a guide plate 45 with a card 46. The chain-dotted-line framing around the card 46 is intended to indicate that the chute 1 can be connected to other fiber preparation or spinning plant machines supplied with fiber webs for processing.

The card 46 may be of conventional construction. It comprises a feed roller 47 driven by a drive 56, a taker-in 48 driven by a drive 57, a swift 49 and associated flats 50, a doffer 51, a draw-off roller 52, a pair of crushing rollers 53, a condenser 54 and a pair of sensing rollers 55. As indicated in FIG. 1, the elements 51, 52, 53 and 55 are driven by a common drive 58.

Also, the control 39 controls the drives 56, 57 and 58. Controls of this kind are known per se and need not be further described here. In the simplest case the control 39 can be understood as controlling the starting and stopping of the illustrated card drives which can in turn be part of a comprehensive card control not described herein.

In operation fiber flocks go through the head 3 into the chute 6 and are conveyed therefrom by the feed roller 9 and opening cylinder 10 into the stock chute 11. The non-displaceable delivery rollers 12 then compress the flocks in the chute 11 in accordance with the gap "A" to form a fiber web which is conveyed by means of the rollers 12 between the displaceable delivery roller 13 and the opposed stationary delivery roller 12 and is thus pressed to become an even more condensed fiber web. The same then goes to the guide plate 45 and moves thereon to the feed roller 47 and into the card 46.

If for any reason carding has to be stopped, the drives 56, 57 and 58 also are stopped, and the control 39 simultaneously resets the valve 34 so that the pressure line 32 discharges and the pressure line 41 charges up. Consequently, the displaceable delivery roller 13 pivots back into its non-operating position in the direction W and the actuator 42 closes the flap 43.

However, the movement according to the invention of the displaceable delivery roller 13 from its operating position into its non-operating position is of course not dependent upon the combination with the flap 43. However, if the feed chute has a flap as shown herein or a similar flap, the combination is advantageous.

Upon the resumption of carding, the valve 34 returns to its position shown in FIG. 1 so that the displaceable delivery roller 13 and the actuator 42 return to their respective operative positions. The flap 43 then is once again free to be moved by the air movements, the latter term denoting the air flow from chamber 8 into casing 4.

Figure 4:
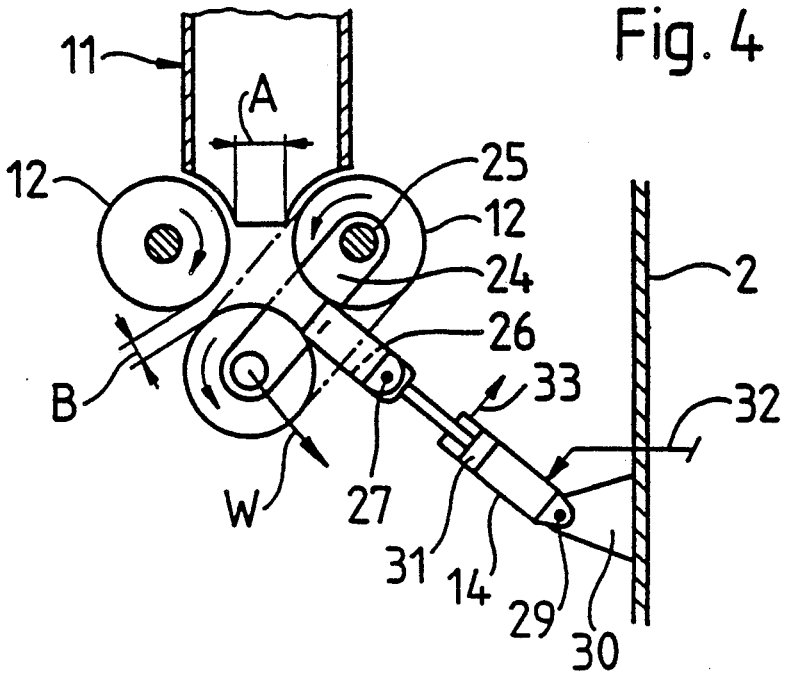
FIG. 4 shows another detail of the chute on the section line II—II of FIG. 5 and to an enlarged scale.
Figures 6, 7, 8:
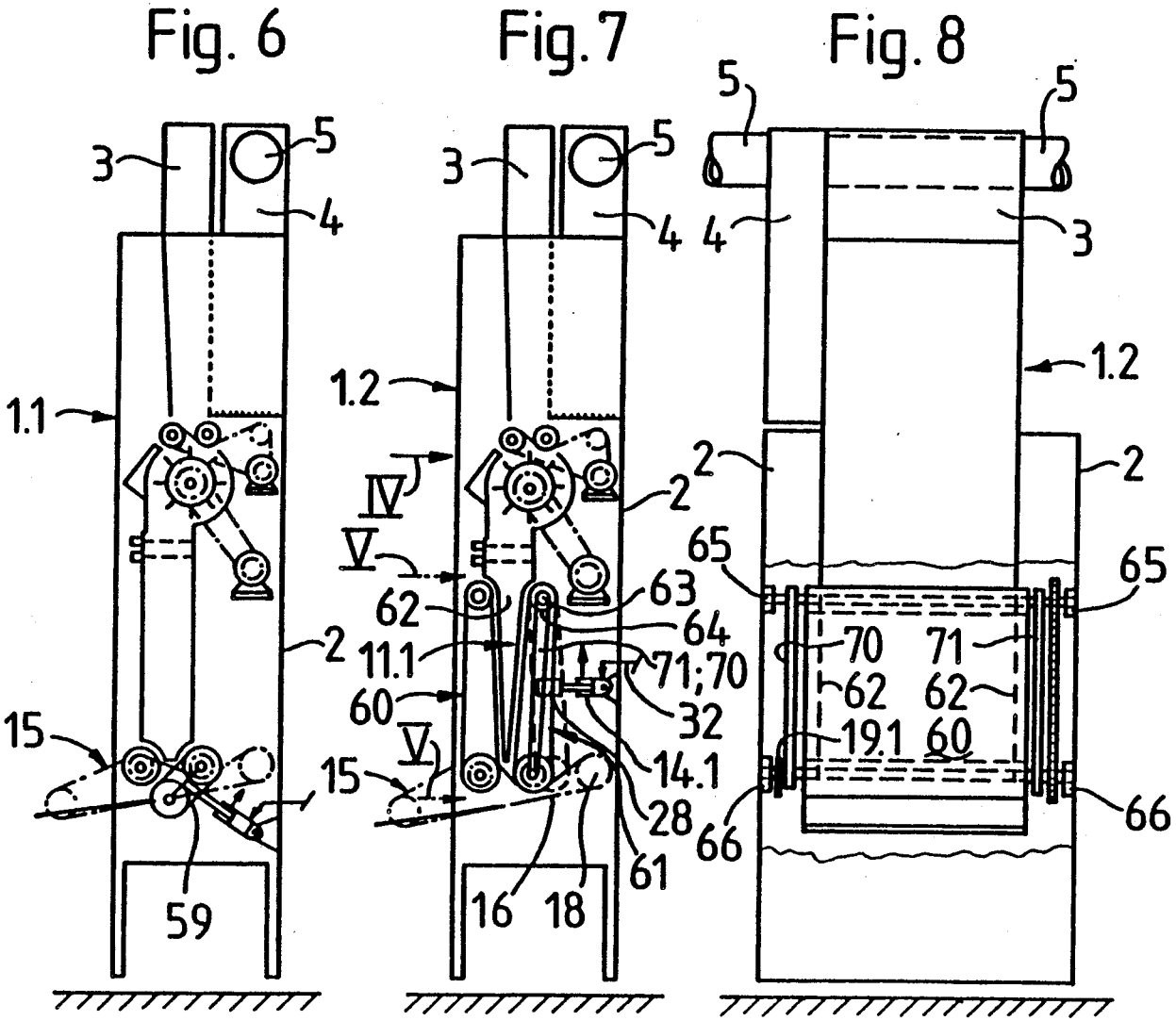
FIGS. 6 and 7 each show a variant of the chute of FIG. 1.
FIG. 8 is a view looking in the direction IV and on the section line V—V of the chute shown in FIG. 7.

FIG. 6 shows a feed chute 1.1 which is a variant of the chute 1 of FIG. 1 to the extent that it comprises a conveyor belt 59 around the displaceable delivery roller 13 and the associated non-displaceable delivery roller 12, so that the conveyor belt 59 conveys the fiber web being compressed and fed toward the card. The stirrup 26 engages over the conveyor belt 59, as indicated in FIG. 4 by the chain-dotted-line representation of the conveyor belt 59.

Consequently, the driving chain 20 and the chain-receiving sprockets (not shown) can be omitted since the displaceable roller 13 can be driven from the non-displaceable roller 12 by way of the conveyor belt 59. Alternatively, the chain and associated sprockets can be retained and the conveyor belt 59 need not be relied upon to provide a drive function.

All the other elements of the chute 1.1 correspond to those of the chute 1 and so need not be further described.

FIG. 7 shows a feed chute 1.2 which is a variant of the chute 1 of FIG. 1 to the extent that the stock chute 11.1 of FIG. 7 is formed by a conveyor belt 60, a conveyor belt 61 opposite the same and two end walls 62 (only one end wall 62 being visible in FIG. 7).

The conveyor belt 60 is non-displaceable and the conveyor belt 61 is arranged for pivoting around a pivot 63. The same is also the pivot for the reversing roller 64 which is at the top in FIG. 7.

As can be gathered from FIG. 7, the bottom reversing rollers of the conveyor belts 60, 61 are driven in the same way as the non-displaceable rollers 12 except that the idler gear 18 of the drive 15 must be able to receive the movements of the pivoted belt 61.

Figure 5:
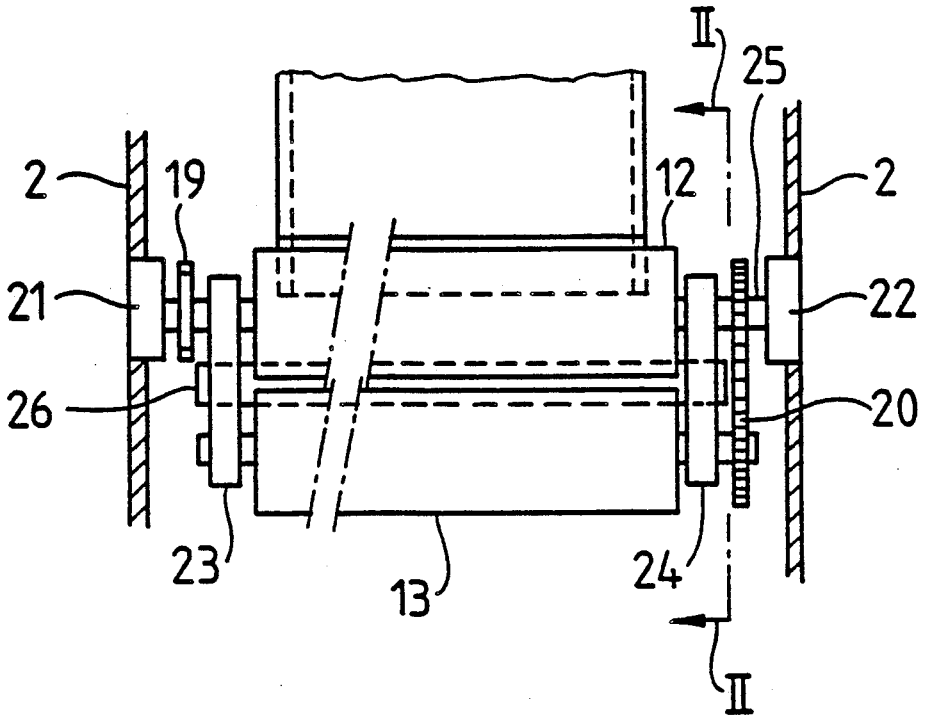
FIG. 5 shows details of FIG. 4 looking in the direction of the line III—III of FIG. 1.

The reversing rollers of the belt 61 are interconnected at their ends by links 70 and 71 (FIG. 8) in the same way as shown in FIGS. 4 and 5 with respect to the pivoted links 23 and 24. The connecting links 70 and 71 are connected to a stirrup 28 similar to the stirrup 26 of FIG. 4, and the reciprocating actuator 14.1 can be pivotally secured to the stirrup 28. The actuator 14.1 is pivotally secured to the casing 2 and connected to the pressure line 32 in exactly the same way as the actuator 14 of FIG. 4.

Due to the pivoting feature of the conveyor belt 61, the bottom reversing roller thereof can, just like the displaceable delivery roller 13, be pivoted towards the bottom reversing roller of the belt 60, to bring the belt 61 into the operative position, and can pivot the belt 61 back into its inoperative normal position when carding stops to relieve the compression exerted on the fiber web by the opposed lower end portions of the belts.

FIG. 8 shows, on the left of each of the conveyor belts 60 and 61 as they are seen in FIG. 8, a sprocket 19.1 corresponding to the sprocket 19 of FIG. 5. A sprocket 19.1 is provided on each of the two bottom shafts of the belts 60 and 61, there being visible on the right-hand side thereof a chain 20.1 which cooperates with a corresponding sprocket (not shown) to drive the top reversing roller unless the same is driven by the belt itself.

FIG. 8 shows only the non-displaceable conveyor belt 60. As will be apparent, the two free ends of the shaft of the top reversing roller are disposed one each in a bearing 65 secured to the casing 2, and the ends of the shaft of the bottom reversing roller are rotatably mounted in bearings 66 secured in the casing 2. Also, of course, the shaft of the top reversing roller of the belt 61 has its two free ends rotatably mounted in bearings in the casing 2 just like the shaft of the reversing roller of the belt 60, while the shaft of the bottom reversing roller of the belt 61 is rotatably mounted in the links 70 and 71.

Figure 9:
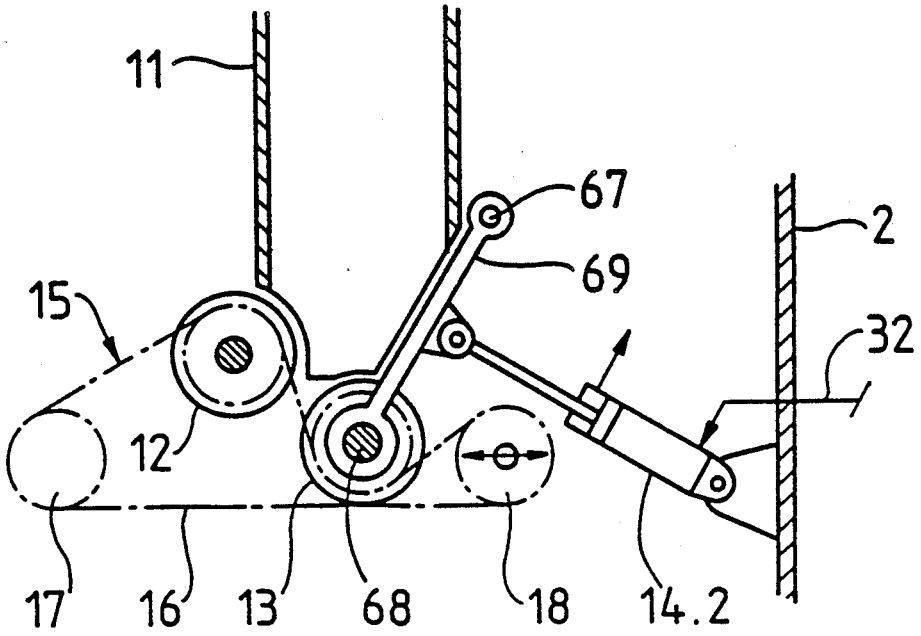
FIG. 9 shows a variant of the detail of FIG. 4.

FIG. 9 shows another variant wherein the non-displaceable delivery roller 12 shown on the right of FIG. 4 is omitted and the displaceable delivery roller 13 is mounted for pivoting around the pivot 67. To this end, shaft 68 of the displaceable roller 13 is mounted for rotation in a swivel plate 69 pivotally connected to the actuator 14.2 which is pivotably mounted on the casing 2.

The displaceable roller 13 has a gear 19 thereon like the gear on the non-displaceable roller 12, and the chain 16 of the drive 15 extends around the sprockets, as shown in chain-dotted lines in FIG. 9, in order to drive the displaceable roller 13 in a direction of rotation opposite to that of the non-displaceable roller 12. The other elements are the same and correspondingly have like references. The stock chute 11.1 is adapted, as compared with the feed chute 11, to suit the swivel plate 69.

Although several embodiments of the invention have been shown and described in detail, further embodiments will be apparent to persons skilled in the art. Moreover, while the new fiber web supply system is especially advantageous in combination with a card, it also can be combined with other fiber preparation machinery into which a fiber web has to be fed. Accordingly, the foregoing descriptions are to be understood as illustrative only, and the scope of the invention is to be ascertained from the following claims.

What is claimed is:

1. An apparatus for advancing a fiber web towards a fiber preparation machine that is subject to being stopped on occasions, comprising:

first and second advancing means that act in cooperation for advancing a fiber web toward the preparation machine, with relative movement between the first and second advancing means being possible;

drive means for causing relative movement between the first and second advancing means; and control means for controlling the drive means so that when the preparation machine is stopped, the drive means causes relative movement between the first and second advancing means from an operating position, wherein the fiber web is pressed between the first and second advancing means, to a non-operating position wherein the fiber web experiences substantially no pressing between the first and second advancing means.

2. Apparatus for supplying a fiber web to a fiber preparation machine subject to being stopped on occasions, said apparatus comprising web feeding means for advancing a fiber web toward said machine when said machine is operating, said feeding means including opposed components contacting the fiber web from opposite sides;

means for urging said components together while said machine is operating to compress the fiber web therebetween; and means operable when said machine stops for reducing substantially the compression of the fiber web by said components.

3. Apparatus according to claim 2, wherein said opposed components are feed rolls.

4. Apparatus according to claim 2, wherein said opposed components are endless belts each moving through a closed path, and wherein a guide is disposed within one of said closed paths and is movable toward and away from an opposed guide within the closed path of movement of the other belt.

5. Apparatus according to claim 2, wherein said means for reducing the compression of the fiber web includes means for moving one of said opposed components away from the other of said opposed components to increase the space therebetween.

6. An apparatus for delivering a textile fiber web from a feed chute in a spinning plant, the apparatus comprising at least one non-displaceable delivery means and at least one delivery means displaceable towards and away from the non-displaceable delivery means, wherein said displaceable delivery means is movable by drive means controlled by control means whereby, when the delivery means are stopped from delivering fiber, the displaceable delivery means is displaced from an operating position, wherein said displaceable delivery means presses the fiber web on to the non-displaceable delivery means, into a non-operating position, wherein the web experiences substantially no pressing in the delivery means.

7. An apparatus according to claim 6, wherein said non-displaceable delivery means includes two non-displaceable rotatable and driveable delivery rollers disposed at a predetermined spacing from one another, and wherein said displaceable delivery means takes the form of a driveable delivery roller movable towards and away from a first of the non-displaceable delivery rollers.

8. An apparatus according to claim 7, wherein said displaceable delivery roller is mounted for pivoting.

9. An apparatus according to claim 8, wherein said pivoted delivery roller is connected to a second of the non-displaceable rollers by a conveyor belt extending substantially over the whole length of the rollers, and a shaft of said second non-displaceable delivery roller provides a pivot axis for said displaceable delivery roller.

10. An apparatus according to claim 6, wherein said non-displaceable delivery means takes the form of a non-displaceable conveyor belt surrounding a top reversing roller and a non-displaceable bottom reversing roller, and wherein said displaceable delivery means takes the form of a pivoted conveyor belt surrounding a non-displaceable top reversing roller and a displaceable bottom reversing roller displaceable relative to said non-displaceable bottom reversing roller of the non-displaceable belt.

11. The combination of a carding machine and means for supplying a fiber web to said machine, said supplying means including means for forming a loose web of fiber flocks, means for compressing and feeding said web to operating instrumentalities of said carding machine, and means for rendering said compressing means inoperable when said carding machine is stopped, so as to obviate substantially the formation of a more highly compacted web zone in a portion of the fiber web ready to be fed to the operating instrumentalities of the carding machine upon resumption of operation of the carding machine.

12. The combination according to claim 11, wherein said means for feeding said web to the operating instrumentalities of said carding machine is stopped when said carding machine is stopped.

13. The combination according to claim 12, including control means for substantially concurrently rendering said compressing means inoperable and stopping both said carding machine and said web feeding means.

14. An apparatus for delivering a textile fiber web from a feed chute in a spinning plant, the apparatus comprising at least one non-displaceable delivery means and at least one delivery means displaceable towards and away from the non-displaceable delivery means, wherein said displaceable delivery means is movable by drive means controlled by control means whereby, when the delivery means are stopped from delivering fiber, the displaceable delivery means is displaced from an operating position, wherein said displaceable delivery means presses the fiber web on to the non-displaceable delivery means, into a non-operating position wherein the web experiences substantially no pressing in the delivery means, said drive means taking the form of a single-acting spring-returned electropneumatic reciprocating actuator.

15. An apparatus according to claim 14, wherein the pressure for activating said electropneumatic actuator is maintained at a predetermined value by a pressure-regulating valve.

16. An apparatus for delivering a textile fiber web from a feed chute in a spinning plant, the apparatus comprising at least one non-displaceable delivery means and at least one delivery means displaceable towards and away from the non-displaceable delivery means, wherein said displaceable delivery means is movable by drive means controlled by control means whereby, when the delivery means are stopped from delivering fiber, the displaceable delivery means is displaced from an operating position, wherein said displaceable delivery means presses the fiber web on to the non-displaceable delivery means, into a non-operating position wherein the web experiences substantially no pressing in the delivery means, said control means taking the form of a 4-way, 2-position valve.

17. An apparatus according to claim 16, wherein said valve is controlled in synchronism with a drive of a fiber preparation machine disposed after the feed chute, so that, when the fiber preparation machine is stopped, the displaceable delivery means moves from said operating position into said non-operating position.

18. An apparatus for delivering a textile fiber web from a feed chute in a spinning plant, the apparatus comprising at least one non-displaceable delivery means and at least one delivery means displaceable towards and away from the non-displaceable delivery means, wherein said displaceable delivery means is movable by drive means controlled by control means whereby, when the delivery means are stopped from delivering fiber, the displaceable delivery means is displaced from an operating position, wherein said displaceable delivery means presses the fiber web on to the non-displaceable delivery means, into a non-operating position wherein the web experiences substantially no pressing in the delivery means, said feed chutes including pneumatic filling means and an exhaust air flap, and wherein a single-acting, spring-returned electropneumatic reciprocating actuator controls said flap in synchronism with the drive means for moving said displaceable delivery means so that, when the flap is in a closed position, the displaceable deliver means is in said non-operating position.

19. A method of minimizing irregularities in carding machine slivers occasioned by temporary carding machine shutdowns, comprising removing substantially, during carding machine shutdowns, a compressive force on a web of fiber flocks in position to be fed into the carding machine so as to minimize setting of a portion of the then stationary web in a more highly compacted condition.

* * * * *